US011326799B2

(12) United States Patent
Matsuda et al.

(10) Patent No.: US 11,326,799 B2
(45) Date of Patent: May 10, 2022

(54) CONTROLLER, OUTDOOR UNIT, HEAT SOURCE APPARATUS AND AIR CONDITIONING SYSTEM

(71) Applicant: Mitsubishi Electric Corporation, Tokyo (JP)

(72) Inventors: Takuya Matsuda, Tokyo (JP); Naofumi Takenaka, Tokyo (JP); Kimitaka Kadowaki, Tokyo (JP); Yuji Motomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 130 days.

(21) Appl. No.: 16/963,366

(22) PCT Filed: Apr. 3, 2018

(86) PCT No.: PCT/JP2018/014292
§ 371 (c)(1),
(2) Date: Jul. 20, 2020

(87) PCT Pub. No.: WO2019/193649
PCT Pub. Date: Oct. 10, 2019

(65) Prior Publication Data
US 2020/0363086 A1 Nov. 19, 2020

(51) Int. Cl.
*F24F 11/46* (2018.01)
*F24F 11/85* (2018.01)
(Continued)

(52) U.S. Cl.
CPC ..... *F24F 11/46* (2018.01); *F24F 5/0003* (2013.01); *F24F 11/85* (2018.01); *F24F 2140/12* (2018.01); *F24F 2140/20* (2018.01)

(58) Field of Classification Search
CPC .. F24F 11/46; F24F 11/85; F24F 11/61; F24F 5/0003; F24F 2140/12
See application file for complete search history.

(56) References Cited

U.S. PATENT DOCUMENTS 7,222,494 B2 * 5/2007 Peterson ..... G05D 23/1904 62/178
10,359,207 B2 * 7/2019 Motomura ..... F25B 25/005
(Continued)

FOREIGN PATENT DOCUMENTS

JP 2004-085141 A 3/2004

OTHER PUBLICATIONS

International Search Report of the International Searching Authority dated Jun. 12, 2018 for the corresponding International application No. PCT/JP2018/014292 (and English translation).

*Primary Examiner* — Nelson J Nieves
(74) *Attorney, Agent, or Firm* — Posz Law Group, PLC

(57) ABSTRACT

A controller has a timer operation mode in which the operation of a refrigeration cycle that operates as a heat source or a cold source is started before a set operation start time of an indoor fan by a preliminary operation time period. In the timer operation mode, the controller calculates a heat capacity of water or brine, calculates a heat storage amount of a second heat medium from a temperature detected by a temperature sensor and the heat capacity, and determines the preliminary operation time period from the heat storage amount. By determining the preliminary operation time period in this manner, timer operation can be performed such that air at an appropriate temperature is blown from an indoor unit at the operation start time of the indoor fan, from the initial time at which an air conditioning apparatus is installed.

7 Claims, 6 Drawing Sheets

(51) Int. Cl.

| | |
|---|---|
| ***F24F 5/00*** | (2006.01) |
| *F24F 140/12* | (2018.01) |
| *F24F 140/20* | (2018.01) |

(56) References Cited

U.S. PATENT DOCUMENTS

| | | | | |
|---|---|---|---|---|
| 2015/0300676 | A1* | 10/2015 | Motomura | F24F 11/48<br>62/186 |
| 2016/0273794 | A1* | 9/2016 | Kotani | F24F 11/83 |
| 2016/0288621 | A1* | 10/2016 | Sakane | B60H 1/2218 |
| 2017/0115025 | A1* | 4/2017 | Mowris | F24H 9/2064 |
| 2017/0268797 | A1* | 9/2017 | Mowris | F24F 11/77 |
| 2019/0203994 | A1* | 7/2019 | Nakagawa | F25B 41/20 |

* cited by examiner

CONTROLLER, OUTDOOR UNIT, HEAT SOURCE APPARATUS AND AIR CONDITIONING SYSTEM

CROSS REFERENCE TO RELATED APPLICATION

This application is a U.S. national stage application of International Application PCT/JP2018/014292 filed on Apr. 3, 2018, the contents of which are incorporated herein by reference.

TECHNICAL FIELD

The present disclosure relates to a controller, an outdoor unit, a heat source apparatus and an air conditioning system.

BACKGROUND

Conventionally, an indirect air conditioning apparatus is known that generates hot and/or chilled water by a heat source apparatus such as a heat pump, and delivers the water to an indoor unit through a water pump and a pipe to perform heating and/or cooling in the interior of a room. In the conventional indirect air conditioning apparatus, in order to avoid blowing of uncomfortable hot air or cold air during start-up, the heat source apparatus and the water pump are preliminarily operated until the start of operation of an indoor fan, and the operation of the indoor fan is started when the circulating hot or chilled water reaches an appropriate temperature. An optimal time period of this preliminary operation varies with heat capacity of a heat medium inherent in the location of installation. When setting a start-up time in advance in a scheduling function, too, the heat capacity of a heat medium varies with pipe length and temperature, resulting in variation in optimal time period of preliminary operation. Thus, a fixed time period of preliminary operation as in conventional apparatuses is problematic in terms of comfort and energy conservation during start-up.

In Japanese Patent Laying-Open No. 2004-85141 (PTL 1), in order to reliably ensure comfort of an occupant at an air conditioner scheduled time in such an indirect air conditioning apparatus, a heat source apparatus start-up time and an air conditioner start-up time are calculated to control a heat source apparatus and an air conditioner.

More specifically, in this air conditioning apparatus, a heat source apparatus optimal start-up time period is determined based on a difference between the temperature of water held in a pipe and the temperature of target heat source water, and a heat source apparatus optimal start-up time is determined by subtracting this heat source apparatus optimal start-up time period from an air conditioner optimal start-up time. Then, when the current time reaches the heat source apparatus optimal start-up time, the heat source apparatus is started and an air conditioner valve attached to the air conditioner is opened.

PATENT LITERATURE

PTL 1: Japanese Patent Laying-Open No. 2004-85141

In the indirect air conditioner described in Japanese Patent Laying-Open No. 2004-85141, an air conditioner optimal start-up time period is calculated based on daily records, the heat source apparatus optimal start-up time period is calculated based on daily records, and the heat source apparatus optimal start-up time is determined from these time periods. However, a method of learning from daily records requires days to learn, and therefore may not be able to ensure comfort of an occupant at the beginning of installation.

SUMMARY

The present disclosure has been made to solve the problem described above, and has an object to provide an air conditioning apparatus attaining both energy conservation and comfort in an indirect air conditioner using water or brine.

The present disclosure relates to a controller that controls an air conditioning system. The air conditioning system includes: a heat source or a cold source for a first heat medium; a first heat exchanger configured to exchange heat between a second heat medium and indoor air; a fan configured to deliver the indoor air to the first heat exchanger; a second heat exchanger configured to exchange heat between the first heat medium and the second heat medium; a pump configured to circulate the second heat medium between the first heat exchanger and the second heat exchanger; and a temperature sensor configured to detect a temperature of the second heat medium. The controller is configured to start operation of the heat source or the cold source before a set operation start time of the fan by a preliminary operation time period. The controller is configured to, before the operation start time of the fan, calculate a heat capacity of the second heat medium, calculate a heat storage amount of the second heat medium from the temperature detected by the temperature sensor and the heat capacity, and determine the preliminary operation time period from the heat storage amount.

According to this configuration, the heat capacity of the second heat medium is calculated, the heat storage amount of the second heat medium is calculated from the temperature detected by the temperature sensor and the heat capacity, the preliminary operation time period is derived from the heat storage amount, and the operation of the heat source or the cold source is started before the set operation start time of the fan by the preliminary operation time period. Therefore, comfort is improved while energy conservation is maintained from the beginning of installation.

An air conditioning apparatus of the present disclosure calculates a heat capacity of a heat medium prior to the start of operation, and determines a preliminary operation time period based on the heat capacity, thus allowing improved comfort while maintaining energy conservation from the beginning of installation.

DETAILED DESCRIPTION

Figure 1:
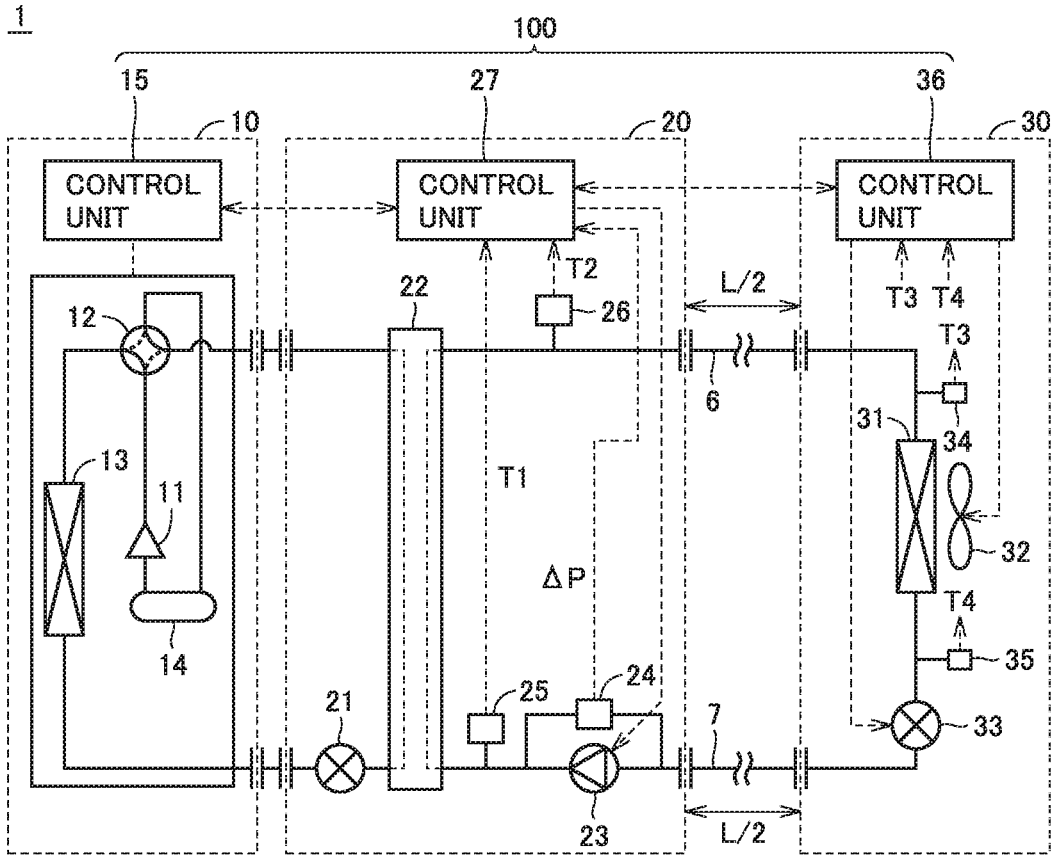
FIG. 1 shows the configuration of an air conditioning apparatus according to a first embodiment.

In the following, embodiments will be described in detail with reference to the drawings. While a plurality of embodiments are described below, it has been intended from the time of filing of the present application to appropriately combine configurations described in the respective embodiments. The same or corresponding parts are designated by the same characters in the drawings and will not be described repeatedly.

First Embodiment

FIG. 1 shows the configuration of an air conditioning apparatus according to a first embodiment. Referring to FIG. 1, an air conditioning apparatus 1 includes an outdoor unit 10, an indoor unit 30, a relay unit 20, temperature sensors 25, 26, 34, 35, a pressure sensor 24, and a controller 100. In the following description, a first heat medium can be exemplified by refrigerant, and a second heat medium can be exemplified by water or brine.

Outdoor unit 10 includes part of a refrigeration cycle that operates as a heat source or a cold source for the first heat medium. Outdoor unit 10 includes a compressor 11, a four-way valve 12, a third heat exchanger 13, and an accumulator 14.

Indoor unit 30 includes a first heat exchanger 31, an indoor fan 32 for delivering indoor air to first heat exchanger 31, and a flow rate adjustment valve 33 for adjusting a flow rate of the second heat medium. First heat exchanger 31 exchanges heat between the second heat medium and the indoor air.

Relay unit 20 includes a second heat exchanger 22, and a pump 23 for circulating the second heat medium between indoor unit 30 and the outdoor unit. Second heat exchanger 22 exchanges heat between the first heat medium and the second heat medium. A plate heat exchanger can be used as second heat exchanger 22.

Indoor unit 30 and relay unit 20 are connected to each other by pipes 6 and 7 for flowing the second heat medium.

Note that in the following, the refrigeration cycle included in outdoor unit 10 and relay unit 20 may be referred to as a heat source apparatus.

Temperature sensors 25, 26, 34 and 35 detect a temperature of the second heat medium. Pressure sensor 24 detects a differential pressure before and after pump 23. Control units 15, 27 and 36 distributed among outdoor unit 10, relay unit 20 and indoor unit 30 cooperate with one another to operate as controller 100. Controller 100 controls compressor 11, pump 23, flow rate adjustment valve 33 and indoor fan 32 in response to outputs from temperature sensors 25, 26, 34 and 35.

Note that one of control units 15, 27 and 36 may serve as a controller, and control compressor 11, pump 23, flow rate adjustment valve 33 and indoor fan 32 based on data detected by the other control units 15, 27 and 36. Note that in the case of a heat source apparatus where outdoor unit 10 and relay unit 20 are integrated together, control units 15 and 27 may cooperate with each other to operate as a controller based on data detected by control unit 36.

In indirect air conditioning apparatus 1 having such a configuration, during start-up, outdoor unit 10, relay unit 20 and indoor unit 30 are preliminarily operated until the start of operation of indoor fan 32 to blow air at a comfortable temperature into the room. In the preliminary operation, the first heat medium (refrigerant) and the second heat medium (water or brine) are circulated and the second heat medium (water or brine) is preheated (or precooled), while indoor fan 32 is stopped. A preliminary operation time period required for preliminary operation to perform adequate preheating (or precooling) varies with heat capacity of a heat medium. When setting a start-up time in advance in a scheduling function, too, the heat capacity of a heat medium varies with pipe length and temperature, resulting in variation in optimal preliminary time period until the start of operation of indoor fan 32.

Therefore, in a scheduling function of setting an operation start time of air conditioning apparatus 1 in advance, controller 100 calculates a heat storage amount Qw of the second heat medium (water or brine), and sets a preliminary operation time period in accordance with calculated heat storage amount Qw.

Controller 100 has a timer operation mode in which the operation of the refrigeration cycle that operates as a heat source or a cold source is started before a set operation start time of indoor fan 32 by the preliminary operation time period. In the timer operation mode, controller 100 calculates a heat capacity Cw of the second heat medium, calculates heat storage amount Qw of the second heat medium from the temperatures detected by temperature sensors 25, 26, 34, 35 and heat capacity Cw, and determines the preliminary operation time period from heat storage amount Qw.

By determining the preliminary operation time period as described above, timer operation can be performed such that air at an appropriate temperature is blown from indoor unit 30 at the operation start time of indoor fan 32, from the initial time at which air conditioning apparatus 1 is installed.

Figure 2:
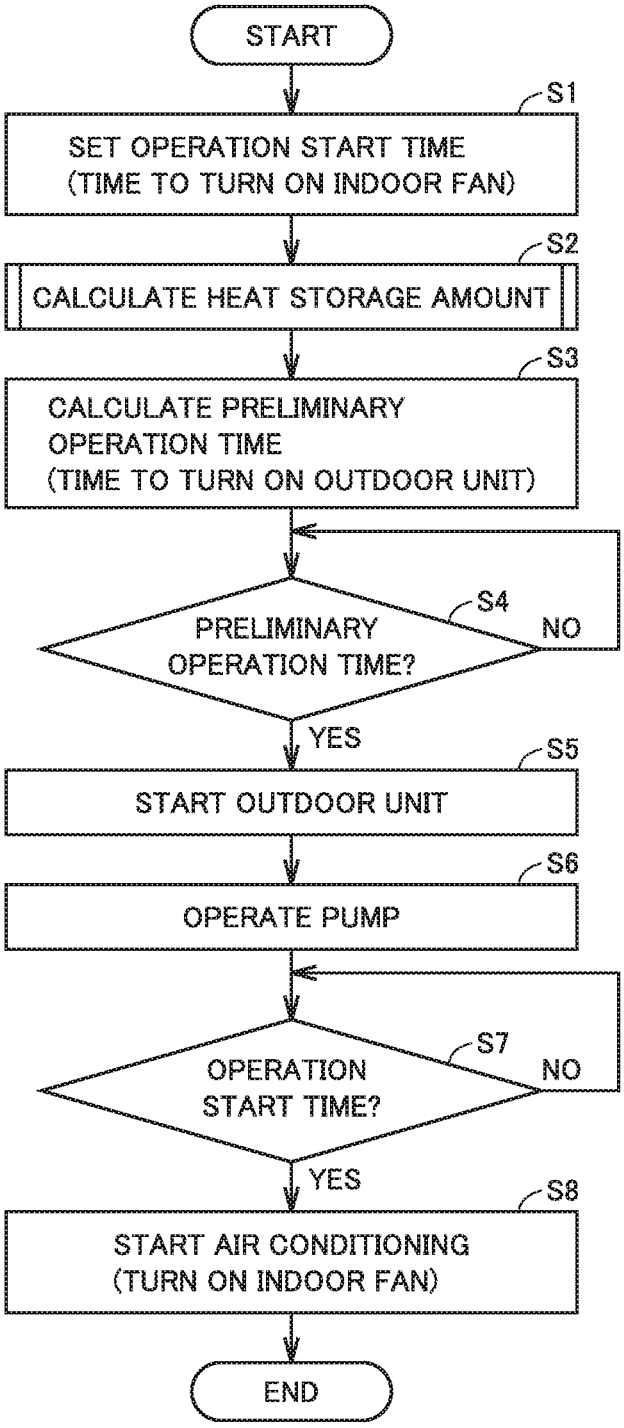
FIG. 2 is a flowchart to illustrate control of preliminary operation in a timer operation mode performed by a controller in the first embodiment.

FIG. 2 is a flowchart to illustrate control of preliminary operation in the timer operation mode performed by the controller in the first embodiment. Referring to FIGS. 1 and 2, in step S1, controller 100 sets a desired time to start cooling operation or heating operation (operation start time) by input from a user. The "operation start time" as used here is a time at which the temperature of a heat medium reaches a prescribed temperature, and indoor fan 32 is turned on to start blowing of air into the room from indoor unit 30.

Then, in step S2, controller 100 calculates heat storage amount Qw of the second heat medium. When heat storage amount Qw of the second heat medium is too low or too high, rotation of indoor fan 32 causes uncomfortable air to be blown into the room. If the operation has been performed until just before the current time, for example, heat storage amount Qw of the second heat medium corresponds to a temperature suitable for heating or cooling. The preliminary operation time period may be short in this case. If it has been a long time since the operation was stopped, however, the temperature of the second heat medium has approached an outdoor air temperature, and is thus at a temperature unsuitable for heating or cooling. The preliminary operation time period thus needs to be extended in this case.

For this reason, controller 100 calculates heat storage amount Qw of the second heat medium in step S2, in order to determine the preliminary operation time period. Once heat storage amount Qw is determined, controller 100 calculates, from the capability of the heat source apparatus, a preliminary operation time period over which the second heat medium reaches a set temperature. Note that the outdoor air temperature is also taken into consideration since the capability of the heat source apparatus depends on the outdoor air temperature.

When the calculation of heat storage amount Qw is completed in step S2, controller 100 calculates a preliminary operation start time in step S3. The preliminary operation start time is a time at which the heat source or the cold source in outdoor unit 10 is turned on. The preliminary operation start time is calculated by subtracting the preliminary operation time period from the operation start time set in step S1. When the preliminary operation start time is determined, waiting is conducted until the preliminary operation start time in step S4.

When the preliminary operation start time arrives in step S4, the process proceeds to step S5, where controller 100 starts the heat source or the cold source in outdoor unit 10, and operates pump 23 in step S6. In the preliminary operation, the heat source apparatus is operated, the indoor fan is turned off, and only the pump is operated in the relay unit. Heating or cooling of the second heat medium is thereby started. Then, waiting is conducted until the operation start time in step S7, while the heating or cooling is continued.

When the operation start time arrives in step S7, the process proceeds to step S8, where controller 100 starts to perform air conditioning. Specifically, controller 100 turns on indoor fan 32. By this time, the temperature of the second heat medium has reached the set temperature.

By performing the preliminary operation as described above, comfortable air is delivered from the indoor unit immediately after the start of air conditioning. In addition, by calculating the preliminary operation time period based on heat storage amount Qw, a preheating (or precooling) time period can be calculated more accurately. Note that the preliminary operation start time may be calculated again before the preliminary operation start time is reached. Since the capability of the heat source apparatus depends on the outdoor air temperature, by calculating the preliminary operation start time closer to the preliminary operation start time, a more optimal preliminary operation time period can be calculated. In addition, by calculating the preliminary operation start time when the outdoor air temperature varies by at least a certain amount, or closer to the preliminary operation start time, the preliminary operation start time is not calculated more than needed, so that power consumption can be reduced.

Figure 3:
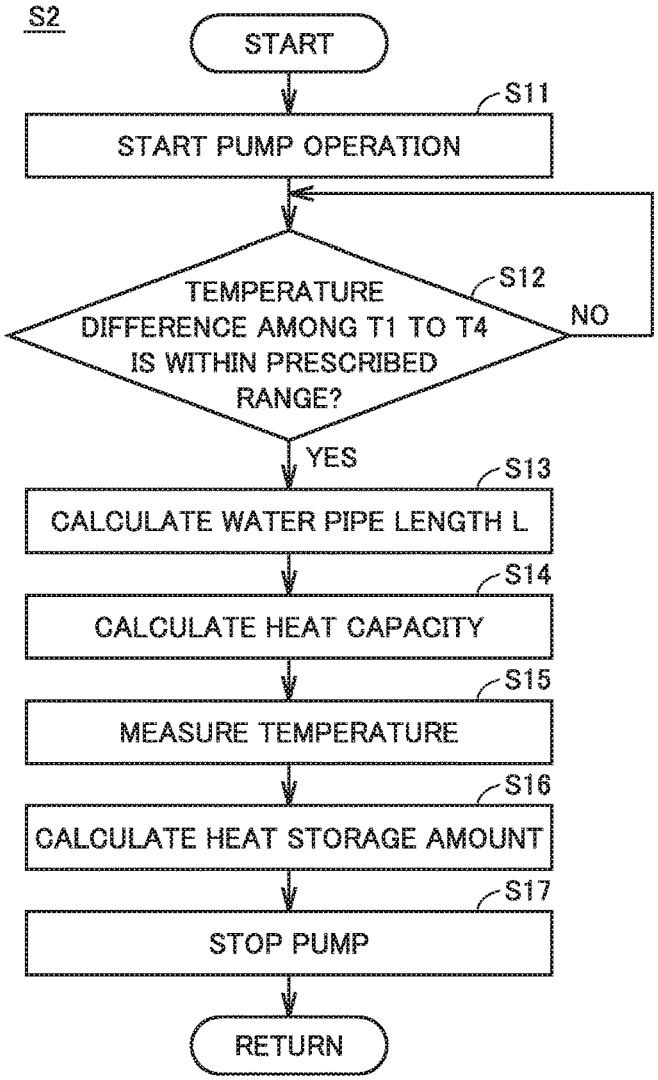
FIG. 3 is a flowchart to illustrate particulars of step S2.

The details of the calculation of heat storage amount Qw in step S2 are now described. FIG. 3 is a flowchart to illustrate particulars of step S2. When calculating heat storage amount Qw, controller 100 calculates heat capacity Cw of the second heat medium, and then calculates heat storage amount Qw by taking the temperature into consideration.

Here, controller 100 starts the operation of pump 23 in step S11, and in step S12, when calculating heat capacity Cw, causes pump 23 to circulate the second heat medium between indoor unit 30 and relay unit 20, then causes temperature sensors 25, 26, 34 and 35 to measure detected temperatures T1 to T4, and waits until a temperature difference among detected temperatures T1 to T4 falls within a prescribed range.

The temperature of the second heat medium forms a temperature distribution gradually due to an indoor load and an outdoor air load, after the air conditioning operation is stopped. For this reason, it is preferred to operate the pump at prescribed time intervals, to uniformize the temperature distribution.

Then, a water pipe length L is calculated in step S13, and heat capacity Cw of the second heat medium is calculated in step S14. Note that water pipe length L is a round-trip length, and either a forward length or a backward length is a length L/2.

In step S13, water pipe length L is calculated from the differential pressure before and after pump 23 measured by pressure sensor 24, a flow rate-head characteristic of the pump, and a flow path resistance characteristic other than the water pipe (the flow rate adjustment valve, the indoor heat exchanger, and the plate heat exchanger).

Figure 4:
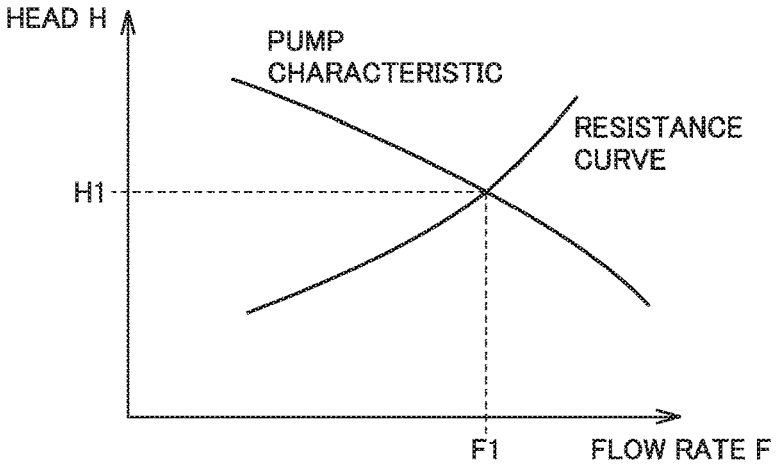
FIG. 4 shows an example of a flow rate-head characteristic of a pump, and a flow path resistance characteristic.

FIG. 4 shows an example of the flow rate-head characteristic of the pump, and the flow path resistance characteristic.

A pump head characteristic (H-F) is known in advance for each applied voltage of the pump. A differential pressure ΔP can be converted to a head in an equation of $\Delta P=\rho gH$. Note that ρ represents density ($kg/m^3$), g represents gravitational acceleration ($m/s^2$), and H represents a head (m). Therefore, when a head H1 is determined from differential pressure ΔP, a pump flow rate F1 is determined from the head characteristic corresponding to the applied voltage of the pump.

On the other hand, measured differential pressure ΔP is the sum of a plate heat exchanger differential pressure ΔP_platehex, a fan coil differential pressure ΔP_fancoil, a flow rate adjustment valve differential pressure ΔP_LEV, and a pipe differential pressure ΔP_pipe of the second heat medium (water), and is expressed in the following Equation (1):

$$\Delta P=\Delta P_\text{platehex}+\Delta P_\text{fancoil}+\Delta P_\text{LEV}+\Delta P_\text{pipe} \quad (1)$$

Here, plate heat exchanger differential pressure ΔP_platehex, fan coil differential pressure ΔP_fancoil, and flow rate adjustment valve differential pressure ΔP_LEV are expressed by a function f of the specification of each element (platehex specification, fancoil specification and LEV specification) and flow rate F1, and therefore, pipe differential pressure ΔP_pipe can be calculated in the following Equation (2):

$$\Delta P_\text{pipe}=\Delta P-f(\text{platehex specification},F1)+f(\text{fancoil specification},F1)+f(\text{LEV specification},F1) \quad (2)$$

Note that f (platehex specification, F1) means a function for calculating a pressure loss from a plate heat exchanger specification and a flow rate. Specifically, a table of flow rate and pressure loss is prepared for each plate heat exchanger specification. Similarly, f (fancoil specification, F1) means a function for calculating a pressure loss from a fan coil specification and a flow rate. Specifically, a table of flow rate and pressure loss is prepared for each fan coil specification. In addition, f (LEV specification, F1) means a function for calculating a pressure loss from a degree of opening of LEV and a flow rate. Specifically, a table of flow rate and pressure loss is prepared for each degree of opening of LEV.

As to pipe differential pressure ΔP_pipe, generally, the following Equation (3) of pressure loss also holds:

$$\Delta P_\text{pipe}=\lambda\cdot L/D\cdot\rho\cdot v^2/2 \quad (3)$$

Note that λ represents a pipe friction coefficient, D represents a water pipe diameter, ρ represents density ($kg/m^3$), and v represents a flow velocity in the pipe.

Note that λ can be calculated as $\lambda=0.3164Re^{0.25}$. Re represents a Reynolds number, and can be calculated as $Re=v\cdot D/\mu$. Flow velocity v in the pipe can be calculated from a flow rate F and a cross-sectional area of the water pipe. In addition, μ represents a kinematic viscosity coefficient of water, which is a physical property value and varies with temperature, and thus the value is stored in a table.

In Equation (3) described above, pipe length L can be calculated since everything is known except for pipe length L.

Once pipe length L is determined, heat capacity Cw of the second heat medium can be calculated from pipe diameter D and a specific heat of the second heat medium in step S14.

Then, the temperature is measured at one of temperature sensors 25, 26, 34 and 35 in step S15 of FIG. 3. Based on this temperature and heat capacity Cw, heat storage amount Qw of the second heat medium is calculated in step S16, and then pump 23 is temporarily stopped in step S17.

Since the temperature is measured at one of temperature sensors 25, 26, 34 and 35 after the second heat medium is circulated as described above, the temperature variation of the second heat medium is eliminated, and heat storage amount Qw of the second heat medium can be accurately calculated.

In addition, as shown in FIG. 3, controller 100 stops the operation of pump 23 after causing pump 23 to circulate the second heat medium between indoor unit 30 and relay unit 20 and calculating heat capacity Cw at least once, then in step S5 of FIG. 2, starts the operation of the heat source or the cold source in outdoor unit 10 before the set operation start time of indoor fan 32 by the preliminary operation time period, and in step S6, starts the operation of pump 23.

Since the temperature is measured at temperature sensor 25, 26, 34 or 35 after the second heat medium is circulated as described above, the temperature variation of the second heat medium is eliminated, and air at a stable temperature can be blown from the operation start time. In addition, since pump 23 is temporarily stopped after the calculation of heat storage amount Qw, power consumption can be reduced.

When temporarily stopping pump 23, it is preferred to repeat the process from step S11 through S17 at prescribed time intervals so as to be able to accurately detect variation in heat storage amount Qw.

As described above, air conditioning apparatus 1 further includes pressure sensor 24 for measuring differential pressure ΔP before and after pump 23. Controller 100 calculates water pipe length L based on differential pressure ΔP before and after pump 23, the flow rate-head characteristic of pump 23 stored in advance, and the flow path resistance characteristics of first heat exchanger 31 and second heat exchanger 22 stored in advance, and calculates heat capacity Cw.

By calculating heat capacity Cw as described above, heat capacity Cw is obtained even if a total amount of the second heat medium sealed at the time of installation or the water pipe length has not been recorded.

Note that instead of the calculation of heat capacity Cw described above, controller 100 may store in advance the volume of the second heat medium sealed in the pipe at the time of installation of the air conditioning apparatus, and use this volume to calculate heat capacity Cw.

(Variation)

Instead of the calculation of heat capacity Cw described above, controller 100 may calculate heat capacity Cw by setting a heat capacity measurement mode after the sealing of the second heat medium is completed, and performing a calculation from an amount of heat of the heat source apparatus and responsivity of water temperature variation, that is, based on an amount of heat provided by the heat source apparatus, which is an amount of heating by the outdoor unit, and a temperature variation detected by the temperature sensor. Control in the heat capacity measurement mode is described below.

Figure 5:
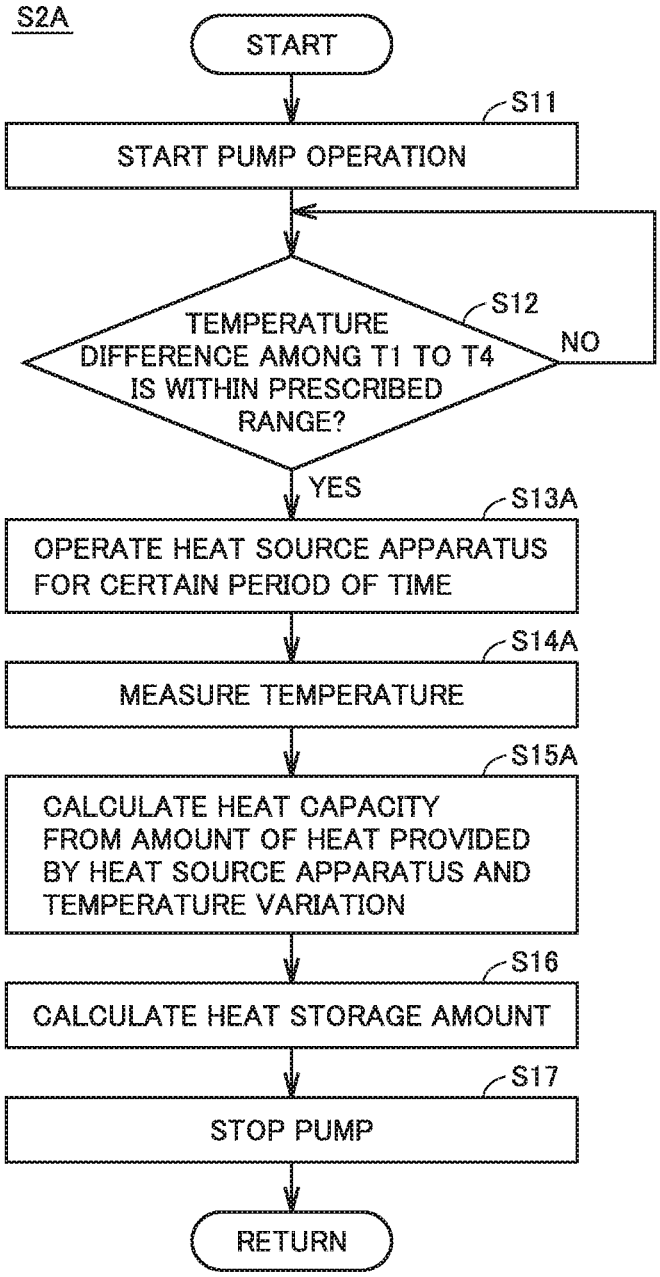
FIG. 5 is a flowchart to illustrate particulars of step S2A which is a variation of step S2.

FIG. 5 is a flowchart to illustrate particulars of step S2A which is a variation of step S2. The process of steps S11, S12, S16 and S17 is the same as that of FIG. 3. Steps S13A, S14A and S15A performed instead of steps S13, S14 and S15 are described here.

In steps S11 and S12, the pump is operated for some period of time in order to uniformize the temperature distribution in the water pipe, and once the temperature distribution is uniformized, in step S13A, controller 100 operates the heat source apparatus for a certain period of time. Then, after the certain period of time, in step S14A, the temperature is measured at one of temperature sensors 25, 26, 34 and 35.

Then, in step S15A, heat capacity Cw of the second heat medium is calculated from the amount of heat provided by the heat source apparatus and the temperature variation.

Here, an integrated amount of heat Qinput (kW) provided by the heat source apparatus can be calculated in the following Equation (4):

$$Q\text{input (kW)}=Gr\cdot\Delta h \tag{4}$$

Note that Gr represents an amount of circulated refrigerant. Amount of circulated refrigerant Gr is stored for each frequency of the compressor, and each intake pipe pressure of the compressor at the heat source apparatus side, in a table storing prestored values. In addition, Δh represents an enthalpy difference before and after a plate heat exchanger. Note that Δh can be calculated from a liquid temperature at a heat exchanger outlet, as well as a pressure and a temperature at a plate heat exchanger outlet, of the heat source apparatus.

In addition, an integrated amount of heat can be calculated as Qinput×operation time t (kJ). Given that the temperature difference is Δt, heat capacity Cw can be calculated in the following Equation (5):

$$Cw=Q\text{input}\cdot t/\Delta t \tag{5}$$

An appropriate preliminary operation time period can be similarly determined also by calculating the heat capacity in this manner.

Second Embodiment

In a second embodiment, a scheduling function of knowing an indoor load in advance and setting a time at which an indoor temperature reaches a set temperature in a timer operation mode is described.

Figure 6:
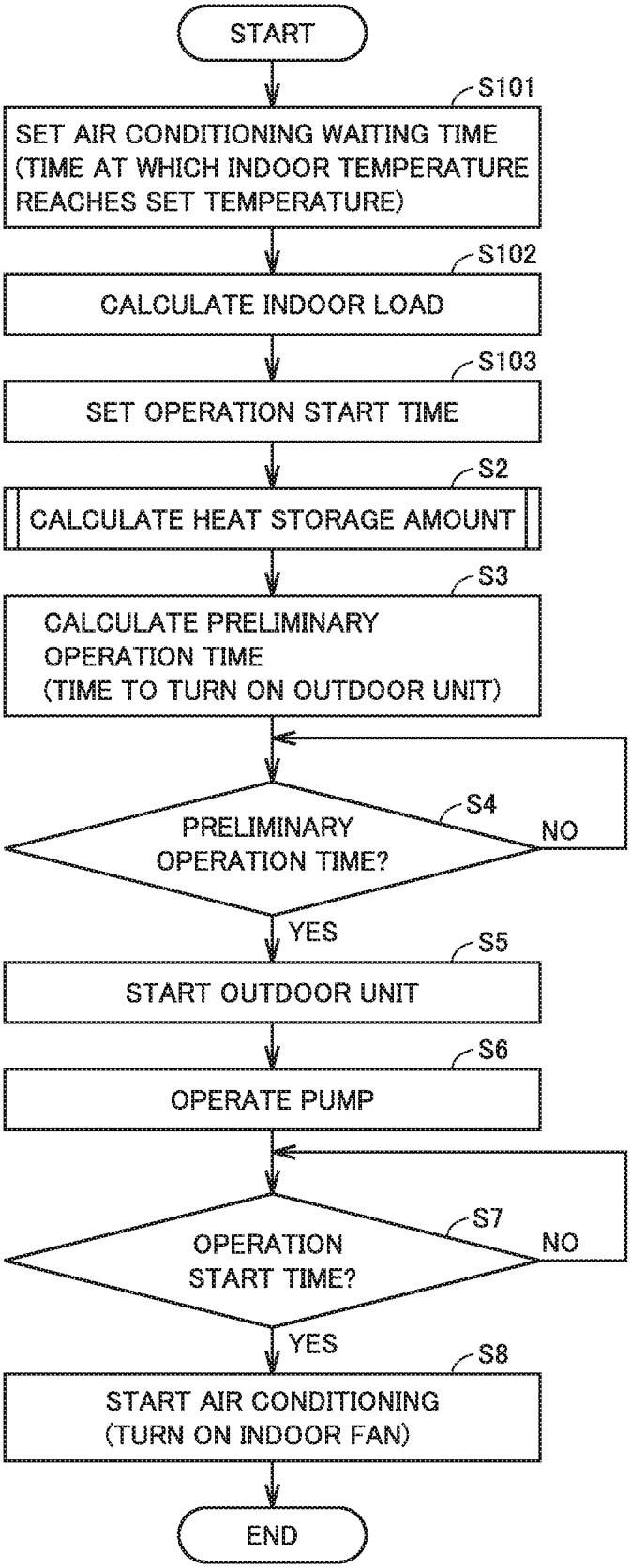
FIG. 6 is a flowchart to illustrate control of preliminary operation in a timer operation mode performed by the controller in a second embodiment.

FIG. 6 is a flowchart to illustrate control of preliminary operation in the timer operation mode performed by the controller in the second embodiment. In the flowchart of FIG. 6, a process of steps S101, S102 and S103 is performed instead of step S1 in the flowchart of FIG. 2.

In step S101, an air conditioning waiting time is input. The air conditioning waiting time is a time at which an indoor temperature reaches a set temperature. For example, the user inputs an expected time of return or an expected time of entry as the air conditioning waiting time.

In step S102, controller 100 calculates an indoor load. The indoor load (kW) may be input by the user, or an indoor temperature and an outdoor air temperature may be set in a table as parameters and controller 100 may measure the indoor temperature and the outdoor air temperature to automatically determine the indoor load.

Then, in step S103, an operation start time is determined in consideration of the air conditioning waiting time and the indoor load, and a similar process to that of S2 through S8 in FIG. 2 is subsequently performed.

According to the second embodiment, the temperature in the room can reach a target temperature precisely at the time set in advance, to improve comfort and energy conservation. In addition, even if the user enters or exits the room before the expected time of entry or exit, air at an uncomfortable temperature is not blown from the air conditioning apparatus, so that the user can be protected from discomfort.

Third Embodiment

Figure 7:
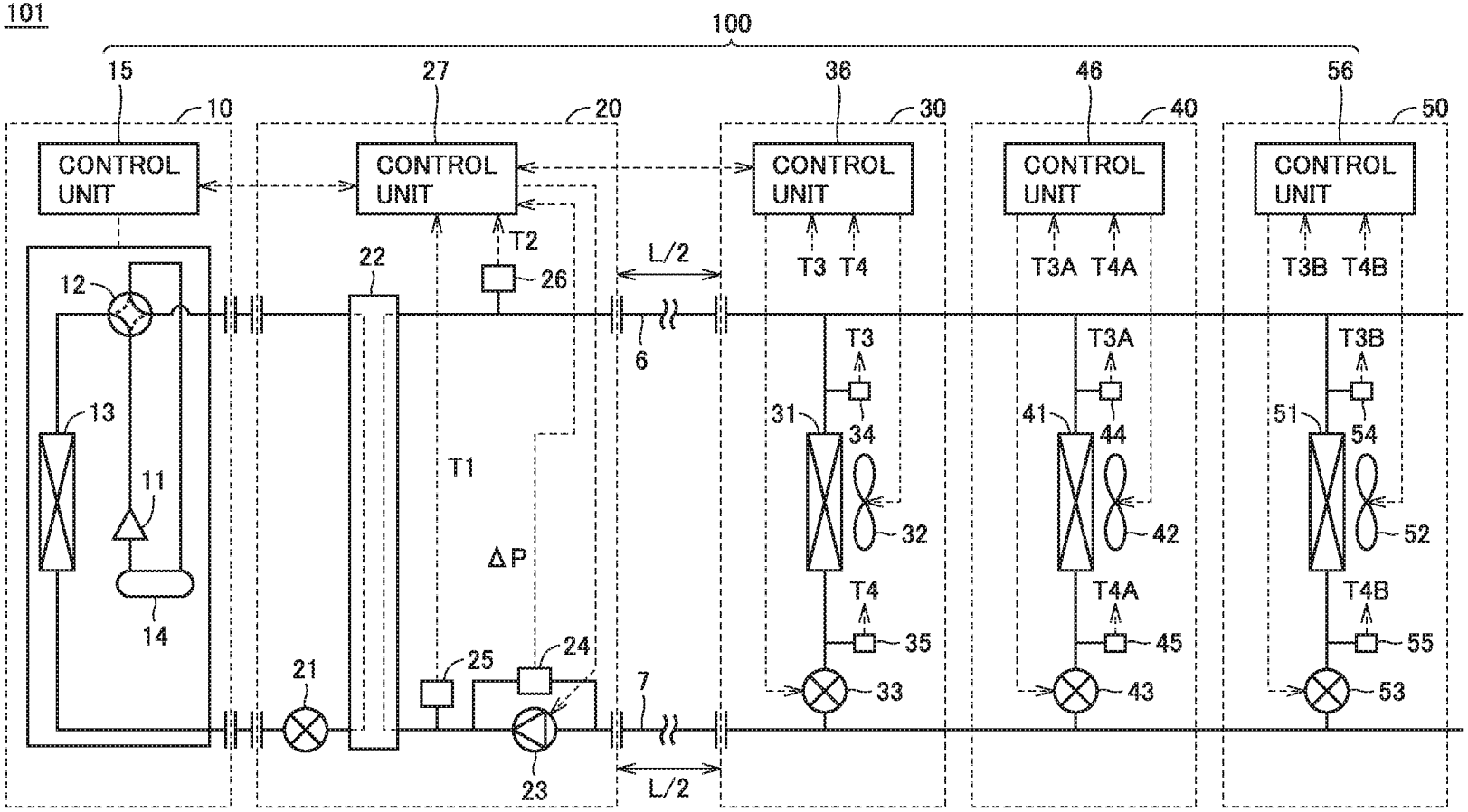
FIG. 7 shows a configuration having a plurality of indoor units.

In a third embodiment, an example where there are a plurality of indoor units is described. FIG. 7 shows a configuration having a plurality of indoor units. An air conditioning apparatus 101 shown in FIG. 7 further includes, in addition to the configuration of air conditioning apparatus 1 shown in FIG. 1, indoor units 40 and 50 connected in parallel with indoor unit 30 through pipes 6 and 7.

Indoor unit 40 includes a first heat exchanger 41, an indoor fan 42 for delivering indoor air to first heat exchanger 41, and a flow rate adjustment valve 43 for adjusting a flow rate of the second heat medium. First heat exchanger 41 exchanges heat between the second heat medium and the indoor air.

Indoor unit 50 includes a first heat exchanger 51, an indoor fan 52 for delivering indoor air to first heat exchanger 51, and a flow rate adjustment valve 53 for adjusting a flow rate of the second heat medium. First heat exchanger 51 exchanges heat between the second heat medium and the indoor air.

Temperature sensors 25, 26, 34, 35, 44, 45, 54 and 55 detect a temperature of the second heat medium. Control units 15, 27, 36, 46 and 56 distributed among outdoor unit 10, relay unit 20 and indoor units 30, 40, 50 cooperate with one another to operate as controller 100. Controller 100 controls outdoor unit 10, pump 23, flow rate adjustment valves 33, 43, 53 and indoor fans 32, 42, 52 in response to outputs from temperature sensors 25, 26, 34, 35, 44, 45, 54 and 55.

Even when there are a plurality of indoor units in this manner, the heat capacity and the heat storage amount can be similarly calculated to determine the preliminary operation time period.

When there is only one indoor unit desired for operation in the scheduling function, for example, the same control as that of the first and second embodiments may be performed.

When there are two or more indoor units desired for operation in the scheduling function, the heat storage amount will vary. In this case, each combination of the indoor units to be operated may have the characteristic of heat capacity Cw. Specifically, when three indoor units 30, 40 and 50 are connected, a total of seven operation patterns are contemplated, including three patterns with one operating indoor unit, three patterns with two operating indoor units, and one pattern with three operating indoor units. For each of these patterns, heat capacity Cw can be calculated from a temperature increase with respect to the amount of provided heat, to calculate the heat storage amount, as was described in the variation of the first embodiment.

It should be understood that the embodiments disclosed herein are illustrative and non-restrictive in every respect. The scope of the present invention is defined by the terms of the claims, rather than the description of the embodiments above, and is intended to include any modifications within the meaning and scope equivalent to the terms of the claims.

The invention claimed is:

1. A controller that controls an air conditioning system, the air conditioning system comprising: a heat source or a cold source for a first heat medium; a first heat exchanger configured to exchange heat between a second heat medium and indoor air; a fan configured to deliver the indoor air to the first heat exchanger; a second heat exchanger configured to exchange heat between the first heat medium and the second heat medium; a pump configured to circulate the second heat medium between the first heat exchanger and the second heat exchanger; and a temperature sensor configured to detect a temperature of the second heat medium, the controller being configured to start operation of the heat source or the cold source before a set operation start time of the fan by a preliminary operation time period, and the controller being configured to, before the operation start time of the fan, calculate a heat capacity of the second heat medium, calculate a heat storage amount of the second heat medium from the temperature detected by the temperature sensor and the heat capacity, and determine the preliminary operation time period from the heat storage amount.

2. The controller according to claim 1, wherein when calculating the heat capacity, the controller is configured to detect the temperature by the temperature sensor after circulating the second heat medium between the first heat exchanger and the second heat exchanger by the pump.

3. The controller according to claim 2, wherein the controller is configured to stop operation of the pump after circulating the second heat medium between the first heat exchanger and the second heat exchanger by the pump and calculating the heat capacity at least once, then to start the operation of the heat source or the cold source before the set operation start time of the fan by the preliminary operation time period, and to start the operation of the pump.

4. The controller according to claim 1, further comprising a pressure sensor configured to measure a differential pressure before and after the pump, wherein the controller is configured to calculate a length of a pipe for circulating the second heat medium based on the differential pressure before and after the pump, a flow rate-head characteristic of the pump stored in advance, and flow path resistance characteristics of the first heat exchanger and the second heat exchanger stored in advance, and calculate the heat capacity.

5. The controller according to claim 1, wherein the controller is configured to calculate the heat capacity based on a volume of the second heat medium stored in advance.

6. The controller according to claim 1, wherein the controller is configured to calculate the heat capacity based on an amount of heating by the heat source, and a temperature variation detected by the temperature sensor.

7. An air conditioning system, comprising the heat source or the cold source, the first heat exchanger, the second heat exchanger, the pump, the temperature sensor, and the controller according to claim 1.

* * * * *